US006937988B1

(12) United States Patent
Hemkumar et al.

(10) Patent No.: US 6,937,988 B1
(45) Date of Patent: Aug. 30, 2005

(54) METHODS AND SYSTEMS FOR PREFILLING A BUFFER IN STREAMING DATA APPLICATIONS

(75) Inventors: Nariankadu Datatreya Hemkumar, Rochester, MN (US); Miroslav Dokic, Austin, TX (US); Vladimir Mesarovic, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 852 days.

(21) Appl. No.: 09/927,735

(22) Filed: Aug. 10, 2001

(51) Int. Cl.[7] ..... G10L 21/04
(52) U.S. Cl. ..... 704/500; 375/364
(58) Field of Search ..... 704/500; 375/364

(56) References Cited

U.S. PATENT DOCUMENTS 5,119,093 A * 6/1992 Vogt et al. ..... 341/123
5,581,748 A * 12/1996 Anderson ..... 713/502
5,905,768 A * 5/1999 Maturi et al. ..... 375/364
6,356,871 B1 * 3/2002 Hemkumar et al. ..... 704/500
6,459,696 B1 * 10/2002 Carpenter et al. ..... 370/350

* cited by examiner

*Primary Examiner*—Daniel Abebe
(74) *Attorney, Agent, or Firm*—Thompson & Knight LLP; James J. Murphy

(57) ABSTRACT

A method of processing a stream of encoded units of data samples includes the step of calculating a sample advantage using timing information embedded in selected ones of the encoded units, the sample advantage representing a time difference in number of samples between the presentation of a reference sample and the availability of the reference sample. A number of phantom samples substantially equal to the number of samples represented by the calculated sample advantage are queued and then output from the queue at a selected rate. Substantially simultaneous with the outputting of the phantom samples from the queue, at least some data samples of at least one encoded unit are decoded and queued behind the phantom samples.

20 Claims, 5 Drawing Sheets

METHODS AND SYSTEMS FOR PREFILLING A BUFFER IN STREAMING DATA APPLICATIONS

CROSS REFERENCE TO RELATED APPLICATIONS

The following co-pending and co-assigned application contains related information and is hereby incorporated by reference:

U.S. Ser. No. 08/970,979 by inventors Divine, et al. entitled "DUAL PROCESSOR DIGITAL AUDIO DECODER WITH SHARED MEMORY DATA TRANSFER AND TASK PARTITIONING FOR DECOMPRESSING COMPRESSED AUDIO DATA, AND SYSTEMS AND METHODS USING THE SAME" filed Nov. 14, 1997 and granted Jun. 27,200 as U.S. Pat. No. 6,081,783; and U.S. Ser. No. 09/332,804 by Hemkumar, et al. entitled "DIGITAL AUDIO DECODING CIRCUITRY, METHODS AND SYSTEMS" filed Nov. 14, 1997, currently pending.

FIELD OF INVENTION

The present invention relates in general to digital signal processing and in particular to methods and systems for prefilling a buffer in streaming data applications.

BACKGROUND OF INVENTION

Under the United States high definition television (HDTV) standard (as promulgated by the Advanced Television Systems Committee), audio, video and associated control and user information are transmitted in a transport stream, for example, that defined under the MPEG2 standard. Within the stream, the video and audio data are themselves compressed into blocks, for example the video may be compressed under one of the MPEG (Motion Pictures Expert Group) formats and the audio under the Dolby AC3® (Dolby® Digital) standard. Other forms of encoding/compression may also be used, for example MPEG audio, AAC audio or MLP audio.

At the transport stream level, a Program Clock Reference (PCR) is periodically inserted in the packet stream. The PCR is a time stamp indicating the then current time with reference to a System Time Clock (STC) base against which the data was encoded into the transport stream. The PCR is used to synchronize corresponding system time clocks in the video and audio decoders.

At the decoder, disposed for example in a television unit or set-top box, the data is demultiplexed and reassembled as a packetized elementary stream (PES). In the PES layer, the audio and video data are packed into blocks along with the corresponding headers required under the specific audio and video compression standards used. The video and audio streams are then switched to the appropriate decoder.

A Presentation Time Stamp (PTS) is periodically inserted in the blocks of compressed audio and video data. The PTS indicates to the respective audio or video decoder when the following block or blocks of data are to be played to the audience. The PTS is also referenced to the STC.

Compression of audio and data is central to both the feasibility and economy of transmission of the information necessary for program dissemination in such applications as digital television and similar systems. Typically, however, decompressing compressed data is a relatively time consuming task. Moreover, decode times are not predictable and can vary significantly between the audio and video processing paths as a result of the use of diverse compression algorithms. Hence, successful use of presentation time stamps is crucial. Additionally, error concealment techniques rely on the time stamps, and therefore to insure that audio and/or video data is not lost, the time stamps and synchronized playback must be effectively used. This aids in mitigating artifacts in the presentation to the end user.

It is incumbent therefore that audio and video systems ensure fidelity playback with respect to a locally regenerated time information using the timestamps recovered from the audio and video subsystems. In sum, therefore, methods of synchronizing a data decoder with a corresponding source of encoded data are required.

SUMMARY OF INVENTION

The principles of the present invention support maximal output buffer prefill and perfect start in processing systems processing streaming data. One such method is directed at processing a stream of encoded units of data samples and includes the step of calculating a sample advantage using timing information embedded in selected ones of the encoded units, the sample advantage representing a time difference expressed in number of samples such that the duration of presentation of said number of samples equals the time difference between the presentation of a reference sample and the availability of the reference sample. A selected number of phantom samples substantially equal to the number of samples represented by the calculated sample advantage are queued. The phantom samples are then output from the queue at a selected rate while substantially simultaneously at least some data samples of at least one encoded unit are decoded and queued behind the phantom samples.

The application of the inventive concepts allow for the output buffer in a streaming data system to be maximally prefilled. Consequently, the necessary steps can be taken to achieve synchronization with respects to a given time base while the output buffer prefill supports the output data stream. Moreover, by undertaking the synchronization process using the output buffer prefill and the required computations, synchronization can timely be achieved such that the first actual data sample can be presented exactly as indicated by the corresponding time stamp (i.e., a perfect start).

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1–7 of the drawings, in which like numbers designate like parts.

Figure 1A:
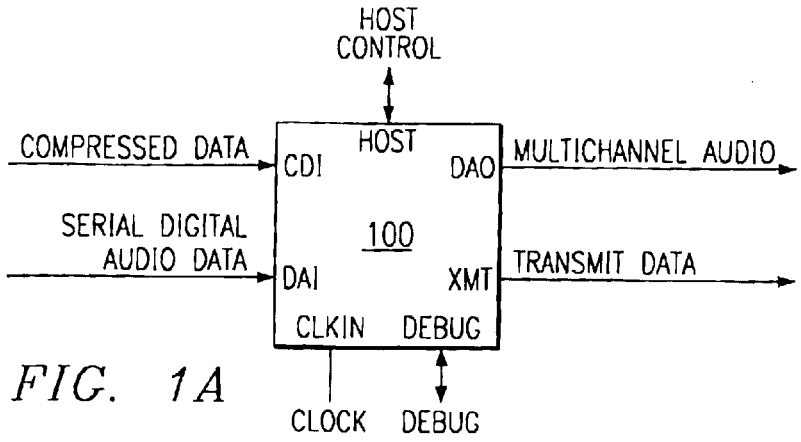
FIG. 1A is a diagram of a multichannel audio decoder embodying the principles of the present invention.

FIG. 1A is a general overview of an audio information decoder 100 embodying the principles of the present invention. Decoder 100 is operable to receive data in any one of a number of formats, including compressed data in conforming to the AC-3 digital audio compression standard, (as defined by the United States Advanced Television System Committee) through a compressed data input port CDI. An independent digital audio data (DAI) port provides for the input of PCM, S/PDIF, or non-compressed digital audio data.

A digital audio output (DAO) port provides for the output of multiple-channel decompressed digital audio data. Independently, decoder 100 can transmit data in the S/PDIF (Sony-Phillips Digital Interface) format through a transmit port XMT.

Decoder 100 operates under the control of a host microprocessor through a host port HOST and supports debugging by an external debugging system through the debug port DEBUG. The CLK port supports the input of a master clock for generation of the timing signals within decoder 100.

While decoder 100 can be used to decompress other types of compressed digital data, it is particularly advantageous to use decoder 100 for decompression of AC-3 bitstreams.

Therefore, for understanding the utility and advantages of decoder 100, consider the case of when the compressed data received at the compressed data input (CDI) port has been compressed in accordance with the AC-3 standard.

Generally, AC-3 data is compressed using an algorithm which achieves high coding gain (i.e., the ratio of the input bit rate to the output bit rate) by coarsely quantizing a frequency domain representation of the audio signal. To do so, an input sequence of audio PCM time samples is transformed to the frequency domain as a sequence of blocks of frequency coefficients. Generally, these overlapping blocks, each of 512 time samples, are multiplied by a time window and transformed into the frequency domain. Because the blocks of time samples overlap, each PCM input sample is represented by two sequential blocks factor transformation into the frequency domain. The frequency domain representation may then be decimated by a factor of two such that each block contains 256 frequency coefficients, with each frequency coefficient represented in binary exponential notation as an exponent and a mantissa.

Next, the exponents are encoded into coarse representation of the signal spectrum (spectral envelope), which is in turn used in a bit allocation routine that determines the number of bits required to encoding each mantissa. The spectral envelope and the coarsely quantized mantissas for six audio blocks (1536 audio samples) are formatted into an AC-3 frame. An AC-3 bit-stream is a sequence of the AC-3 frames.

In addition to the transformed data, the AC-3 bit-stream also includes a number of additional information. For instance, each frame may include a frame header which indicates the bit rate, sample rate, number of encoded samples, and similar information necessary to subsequently synchronize and decode the AC-3 bit stream. Error detection codes may also be inserted such that the device such as decoder 100 can verify that each received frame of AC-3 data does not contain any errors. A number of additional operations may be performed on the bit stream before transmission to the decoder. For a more complete definition of AC-3 compression, reference is now made to the digital audio compression standard (AC-3) available from the advanced televisions systems committee, incorporated herein by reference.

In order to decompress under the AC-3 standard, decoder 100 essentially must perform the inverse of the above described process. Among other things, decoder 100 synchronizes to the received AC-3 bit stream, checks for errors and deformats received AC-3 data audio. In particular, decoder 100 decodes spectral envelope and the quantized mantissas. Among other things, a bit allocation routine is used to unpack and de-quantize the mantissas. The spectral envelope is encoded to produce the exponents, then, an inverse transformation is performed to convert the exponents and mantissas to decoded PCM samples in the time domain.

Figure 1B:
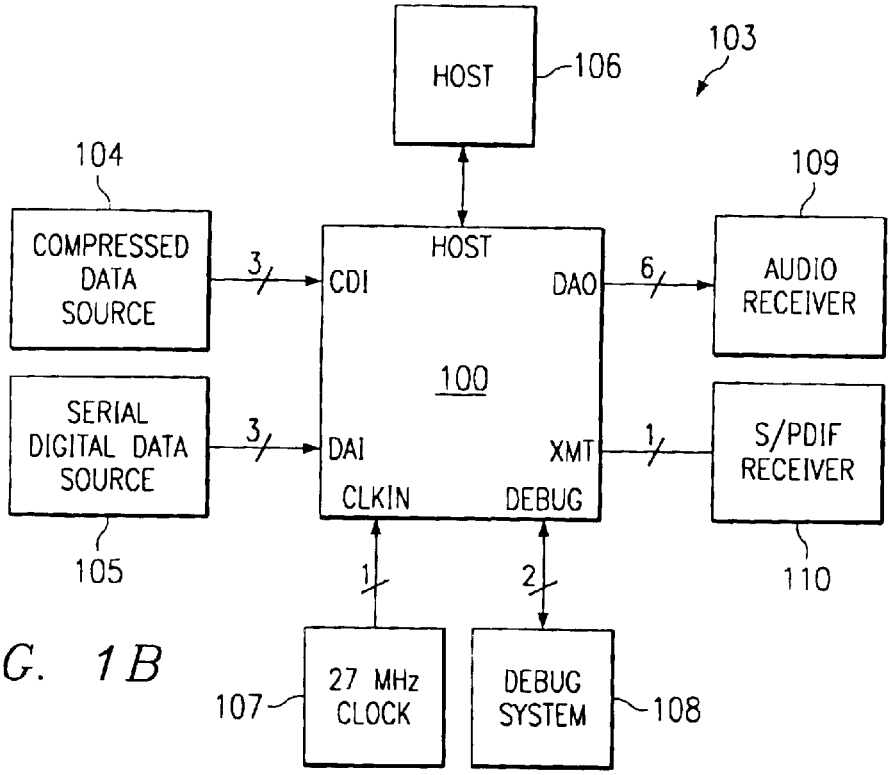
FIG. 1B is a diagram showing the decoder of FIG. 1 in an exemplary system context.

FIG. 1B shows decoder 100 embodied in a representative system 103. Decoder 100 as shown includes three compressed data input (CDI) pins for receiving compressed data from a compressed audio data source 104 and an additional three digital audio input (DAI) pins for receiving serial digital audio data from a digital audio source 105. Examples of compressed serial digital audio source 105, and in particular of AC-3 compressed digital sources, are digital video discs and laser disc players.

Host port (HOST) allows coupling to a host processor 106, which is generally a microcontroller or microprocessor that maintains control over the audio system 103. For instance, in one embodiment, host processor 106 is the microprocessor in a personal computer (PC) and System 103 is a PC-based sound system. In another embodiment, host processor 106 is a microcontroller in an audio receiver or controller unit and system 103 is a non-PC-based entertainment system such as conventional home entertainment systems produced by Sony, Pioneer, and others. A master clock, shown here, is generated externally by clock source 107. The debug port (DEBUG) consists of two lines for connection with an external debugger, which is typically a PC-based device.

Decoder 100 has six output lines for outputting multichannel audio digital data (DAO) to digital audio receiver 109 in any one of a number of formats including 3-lines out, 2/2/2, 4/2/0, 4/0/2 and 6/0/0. A transmit port (XMT) allows for the transmission of S/PDIF data to an S/PDIF receiver 110. These outputs may be coupled, for example, to digital to analog converters or codecs for transmission to analog receiver circuitry.

Figure 1C:
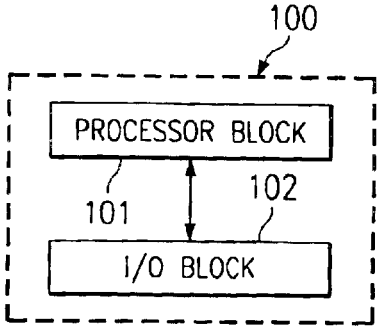
FIG. 1C is a diagram showing the partitioning of the decoder into a processor block and an input/output (I/O) block.

FIG. 1C is a high level functional block diagram of a multichannel audio decoder 100 embodying the principles of the present invention. Decoder 100 is divided into two major sections, a Processor Block 101 and the I/O Block 102. Processor Block 106 includes two digital signal processor (DSP) cores, DSP memory, and system reset control. I/O Block 102 includes interprocessor communication registers, peripheral I/O units with their necessary support logic, and interrupt controls. Blocks 101 and 102 communicate via interconnection with the 110 buses of the respective DSP cores. For instance, I/O Block 102 can generate interrupt requests and flag information for communication with Processor Block 101. All peripheral control and status registers are mapped to the DSP I/O buses for configuration by the DSPs.

Figure 2:
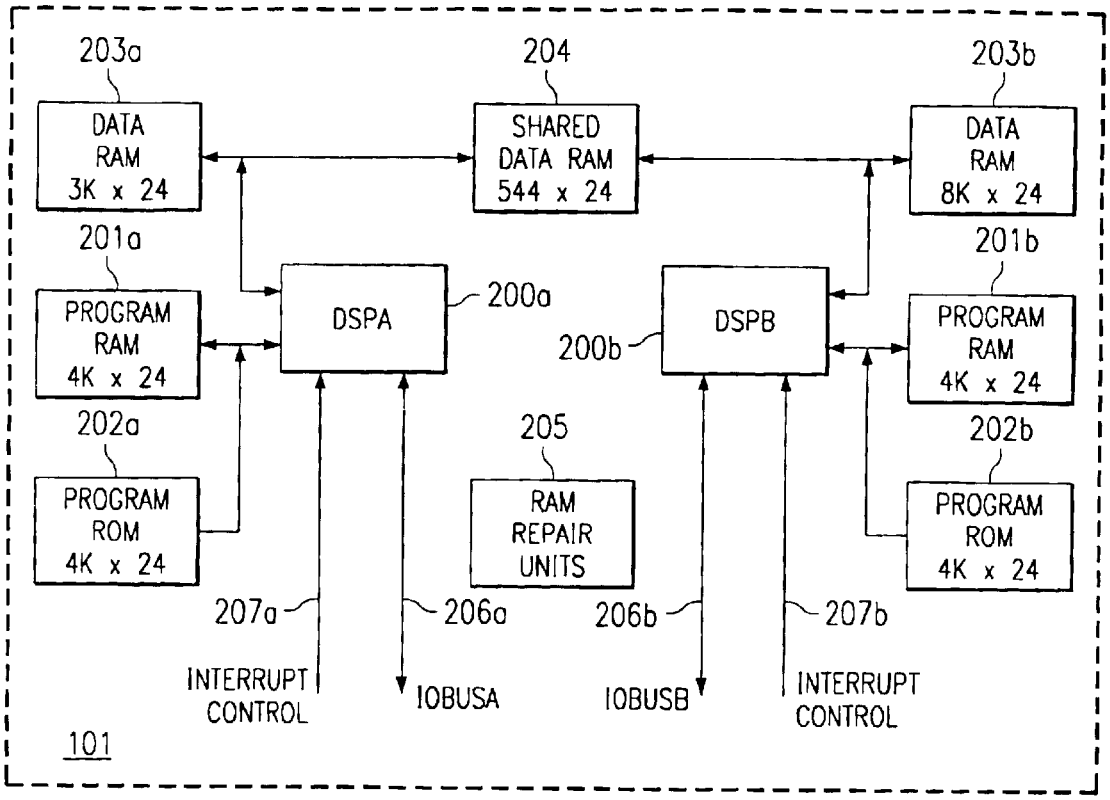
FIG. 2 is a diagram of the processor block of FIG. 1C.

FIG. 2 is a detailed functional block diagram of processor block 101. Processor block 101 includes two DSP cores 200*a* and 200*b*, labeled DSPA and DSPB respectively. Cores 200*a* and 200*b* operate in conjunction with respective dedicated program RAM 201*a* and 201*b*, program ROM 202*a* and 202*b*, and data RAM 203*a* and 203*b*. Shared data RAM 204, which the DSPs 200*a* and 200*b* can both access, provides for the exchange of data, such as PCM data and processing coefficients, between processors 200*a* and 200*b*. Processor block 101 also contains a RAM repair unit 205 that can repair a predetermined number of RAM locations within the on-chip RAM arrays to increase die yield.

DSP cores 200*a* and 200*b* respectively communicate with the peripherals through I/O Block 102 via their respective 110 buses 206*a*, 206*b*. The peripherals send interrupt and flag information back to the processor block via interrupt interfaces 207*a*, 207*b*.

Figure 3:
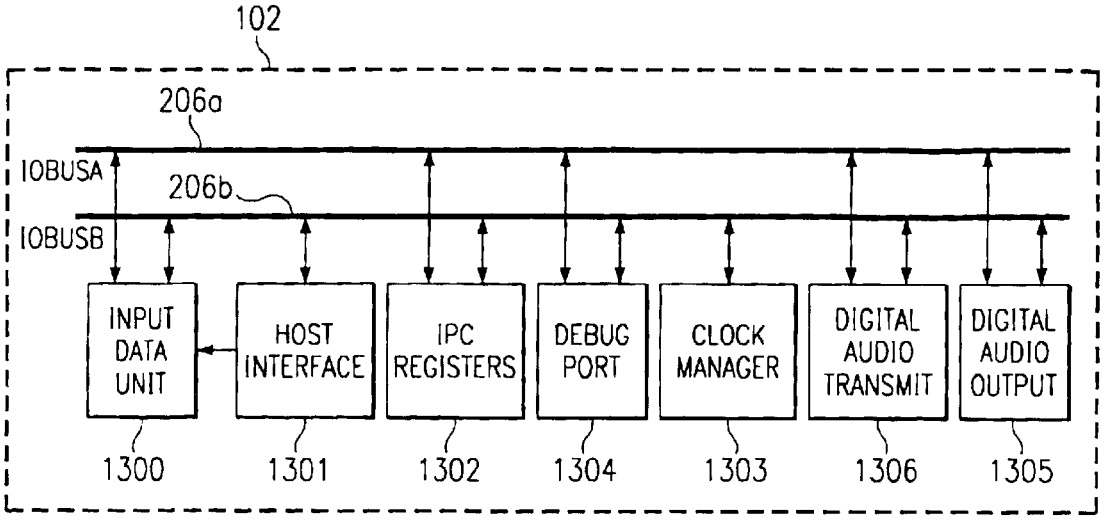
FIG. 3 is a diagram of the primary functional subblock of the I/O block of FIG. 1C.

FIG. 3 is a detailed functional block diagram of I/O block 102. Generally, I/O block 102 contains peripherals for data input, data output, communications, and control. Input Data Unit 1200 accepts either compressed analog data or digital audio in any one of several input formats (from either the CDI or DAI ports). Serial/parallel host interface 1301 allows an external controller to communicate with decoder 100 through the HOST port. Data received at the host interface port 1301 can also be routed to input data unit 1300.

IPC (Inter-processor Communication) registers 1302 support a control-messaging protocol for communication between processing cores 200 over a relatively low-bandwidth communication channel. High-bandwidth data can be passed between cores 200 via shared memory 204 in processor block 101.

Clock manager 1303 is a programmable PLL/clock synthesizer that generates common audio clock rates from any selected one of a number of common input clock rates through the CLKIN port. Clock manager 1303 includes an STC counter which generates time information used by processor block 101 for managing playback and synchronization tasks. Clock manager 1303 also includes a programmable timer to generate periodic interrupts to processor block 101.

Debug circuitry 1304 is provided to assist in applications development and system debug using an external DEBUGGER and the DEBUG port, as well as providing a mechanism to monitor system functions during device operation.

A Digital Audio Output port 1305 provides multichannel digital audio output in selected standard digital audio formats. A Digital Audio Transmitter 1306 provides digital audio output in formats compatible with S/PDIF or AES/EBU.

In general, I/O registers are visible on both I/O buses, allowing access by either DSPA (200*a*)or DSPB (200*b*). Any read or write conflicts are resolved by treating DSPB as the master and ignoring DSPA.

The principles of the present invention further allow for methods of decoding compressed audio data, as well as for methods and software for operating decoder 100. These principles will be discussed in further detail below. Initially, a brief discussion of the theory of operation of decoder 100 will be undertaken.

The Host can choose between serial and parallel boot modes during the reset sequence. The Host interface mode and autoboot mode status bits, available to DSPB 200*b* in the HOSTCTL register MODE field, control the boot mode selection. Since the host or an external host ROM always communicates through DSPB. DSPA 200*a* and 200*b* receives code from DSPB 200*b* in the same fashion, regardless of the host mode selected.

In a dual-processor environment like decoder 100, it is important to partition the software application optimally between the two processors 200*a*, 200*b* to maximize processor usage and minimize inter-processor communication. For this the dependencies and scheduling of the tasks of each processor must be analyzed. The algorithm must be partitioned such that one processor does not unduly wait for the other and later be forced to catch up with pending tasks. For example, in most audio decompression tasks including Dolby AC-3® the algorithm being executed consists of 2 major stages: 1) parsing the input bitstream with specified/computed bit allocation and generating frequency-domain transform coefficients for each channel; and 2) performing the inverse transform to generate time-domain PCM samples for each channel. Based on this and the hardware resources available in each processor, and accounting for other housekeeping tasks the algorithm can be suitably partitioned.

Usually, the software application will explicitly specify the desired output precision, dynamic range and distortion requirements. Apart from the intrinsic limitation of the compression algorithm itself, in an audio decompression task the inverse transform (reconstruction filter bank) is the stage which determines the precision of the output. Due to the finite-length of the registers in the DSP, each stage of processing (multiply+accumulate) will introduce noise due to elimination of the lesser significant bits. Adding features such as rounding and wider intermediate storage registers can alleviate the situation.

For example, Dolby AC-3® requires 20-bit resolution PCM output which corresponds to 120 dB of dynamic range. The decoder uses a 24-bit DSP which incorporates rounding, saturation and 48-bit accumulators in order to achieve the desired 20-bit precision. In addition, analog performance should at least preserve 95 dB SIN and have a frequency response of +/−0.5 dB from 3 Hz to 20 kHz.

Based on application and design requirements, a complex real-time system, such as audio decoder 100, is usually partitioned into hardware, firmware and software. The hardware functionality described above is implemented such that it can be programmed by software to implement different applications. The firmware is the fixed portion of software portion including the boot loader, other fixed function code and ROM tables. Since such a system can be programmed, it is advantageously flexible and has less hardware risk due to simpler hardware demands.

There are several benefits to the dual core (DSP) approach according to the principles of the present invention. DSP cores 200A and 200B can work in parallel, executing different portions of an algorithm and increasing the available processing bandwidth by almost 100%. Efficiency improvement depends on the application itself. The important thing in the software management is correct scheduling, so that the DSP engines 200A and 200B are not waiting for each other. The best utilization of all system resources can be achieved if the application is of such a nature that can be distributed to execute in parallel on two engines. Fortunately, most of the audio compression algorithms fall into this category, since they involve a transform coding followed by fairly complex bit allocation routine at the encoder. On the decoder side the inverse is done. Firstly, the bit allocation is recovered and the inverse transform is performed. This naturally leads into a very nice split of the decompression algorithm. The first DSP core (DSPA) works on parsing the input bitstream, recovering all data fields, computing bit allocation and passing the frequency domain transform coefficients to the second DSP (DSPB), which completes the task by performing the inverse transform (IFFT or IDCT depending on the algorithm). While the second DSP is finishing the transform for a channel n, the first DSP is working on the channel n+1, making the processing parallel and pipelined. The tasks are overlapping in time and as long as tasks are of similar complexity, there will be no waiting on either DSP side.

Figure 4:
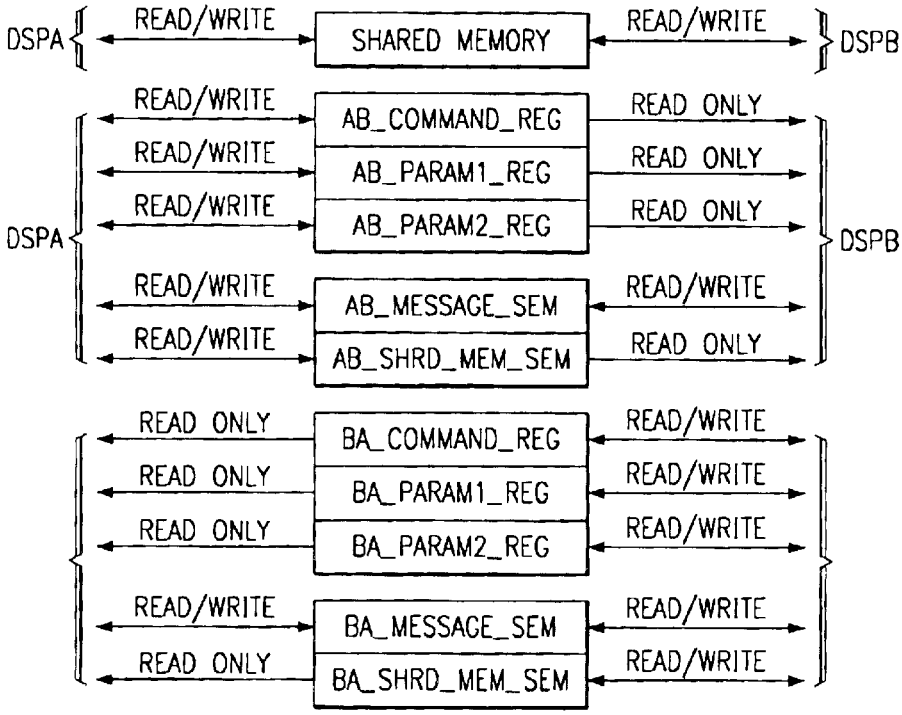
FIG. 4 is a diagram of the interprocessor communications (IPC) registers as shown in FIG. 3

Decoder 100, as discussed above, includes shared memory of 544 words as well as communication "mailbox" (IPC block 1302) consisting of 10 I/O registers (5 for each direction of communication). FIG. 4 is a diagram representing the shared memory space and IPC registers (1302).

One set of communication registers looks like this (a) AB_command_register (DSPA write/read, DSPB read only)

(b) AB_parameter1_register (DSPA write/read, DSPB read only)

(c) AB_parameter2_register (DSPA write/read, DSPB read only)

(d) AB_message_semaphores (DSPA write/read, DSPB write/read as well)

(e) AB_shared_memory_semaphores (DSPA write/read, DSP B read only) where AB denotes the registers for communication from DSPA to DSPB. Similarly, the BA set of registers are used in the same manner, with simply DSPB being primarily the controlling processor.

Shared memory 204 is used as a high throughput channel, while communication registers serve as low bandwidth channel, as well as semaphore variables for protecting the shared resources.

Both DSPA and DSPA 200*a*, 200*b* can write to or read from shared memory 204. However, software management provides that the two DSPs never write to or read from shared memory in the same clock cycle. It is possible, however, that one DSP writes and the other reads from shared memory at the same time, given a two-phase clock in the DSP core. This way several virtual channels of communications could be created through shared memory. For example, one virtual channel is transfer of frequency domain coefficients of AC-3 stream and another virtual channel is transfer of PCM data independently of AC-3. While DSPA is putting the PCM data into shared memory, DSPB might be reading the AC-3 data at the same time. In this case both virtual channels have their own semaphore variables which reside in the AB_shared_memory_semaphores registers and also different physical portions of shared memory are dedicated to the two data channels. AB_command_register is connected to the interrupt logic so that any write access to that register by DSPA results in an interrupt being generated on the DSP B, if enabled. In general, I/O registers are designed to be written by one DSP and read by another. The only exception is AB_message_sempahore register which can be written by both DSPs. Full symmetry in communication is provided even though for most applications the data flow is from DSPA to DSP B. However, messages usually flow in either direction, another set of 5 registers are provided as shown in FIG. 4 with BA prefix, for communication from DSPB to DSPA.

The AB message_sempahore register is very important since it synchronizes the message communication. For example, if DSPA wants to send the message to DSPB, first it must check that the mailbox is empty, meaning that the previous message was taken, by reading a bit from this register which controls the access to the mailbox. If the bit is cleared, DSPA can proceed with writing the message and setting this bit to 1, indicating a new state, transmit mailbox full. The DSPB may either poll this bit or receive an interrupt (if enabled on the DSPB side), to find out that new message has arrived. Once it processes the new message, it clears the flag in the register, indicating to DSPA that its transmit mailbox has been emptied. If DSPA had another message to send before the mailbox was cleared it would have put in the transmit queue, whose depth depends on how much message traffic exists in the system. During this time DSPA would be reading the mailbox full flag. After DSPB has cleared the flag (set it to zero), DSPA can proceed with the next message, and after putting the message in the mailbox it will set the flag to 1. Obviously, in this case both DSPs have to have both write and read access to the same physical register. However, they will never write at the same time, since DSPA is reading flag until it is zero and setting it to 1, while DSPB is reading the flag (if in polling mode) until it is 1 and writing a zero into it. These two processes a staggered in time through software discipline and management.

When it comes to shared memory a similar concept is adopted. Here the AB_shared_memory_semaphore register is used. Once DSPA computes the transform coefficients but before it puts them into shared memory, it must check that the previous set of coefficients, for the previous channel has been taken by the DSPB. While DSPA is polling the semaphore bit which is in AB_shared_memory_semaphore register it may receive a message from DSPB, via interrupt, that the coefficients are taken. In this case DSPA resets the semaphore bit in the register in its interrupt handler. This way DSPA has an exclusive write access to the AB_shared_memory_semaphore register, while DSPB can only read from it. In case of AC-3, DSPB is polling for the availability of data in shared memory in its main loop, because the dynamics of the decode process is data driven. In other words there is no need to interrupt DSPB with the message that the data is ready, since at that point DSPB may not be able to take it anyway, since it is busy finishing the previous channel. Once DSPB is ready to take the next channel it will ask for it. Basically, data cannot be pushed to DSPB, it must be pulled from the shared memory by DSPB.

The exclusive write access to the AB_shared_memory_semaphore register by DSPA is all that more important if there is another virtual channel (PCM data) implemented. In this case, DSPA might be putting the PCM data into shared memory while DSPB is taking AC-3 data from it. So, if DSPB was to set the flag to zero, for the AC-3 channel, and DSPA was to set PCM flag to 1 there would be an access collision and system failure will result. For this reason, DSPB is simply sending message that it took the data from shared memory and DSPA is setting shared memory flags to zero in its interrupt handler. This way full synchronization is achieved and no access violations performed.

When designing a real time embedded system both hardware and software designers are faced with several important trade-off decisions. For a given application a careful balance must be obtained between memory utilization and the usage of available processing bandwidth. For most applications there exist a very strong relationship between the two: memory can be saved by using more MIPS or MIPS could be saved by using more memory. Obviously, the tradeoff exists within certain boundaries, where a minimum amount of memory is mandatory and a minimum amount of processing bandwidth is mandatory.

An example of such trade-off in the AC-3 decompression process is decoding of the exponents for the sub-band transform coefficients. The exponents must arrive in the first block of an AC-3 frame and may or may not arrive for the subsequent blocks, depending on the reuse flags. But also, within the block itself, 6 channels are multiplexed and the exponents arrive in the bitstream compressed (block coded) for all six channels, before any mantissas of any channel are received. The decompression of exponents has to happen for the bit allocation process as well as scaling of mantissas. However, once decompressed, the exponents might be reused for subsequent blocks. Obviously, in this case they would be kept in a separate array (256 elements for 6 channels amounts to 1536 memory locations). On the other hand, if the exponents are kept in compressed form (it takes only 512 memory locations) recomputation would be required for the subsequent block even if the reuse flag is set. In decoder 100 the second approach has been adopted for two reasons: memory savings (in this case exactly 1 k words) and the fact that in the worst case scenario it is necessary to recompute the exponents anyway.

The proper input FIFO is important not only for the correct operation of the DSP chip itself, but it can simplify the overall system in which decoder 100 reside. For example, in a set-top box, where AC-3 audio is multiplexed in the MPEG2 transport stream, the minimum buffering requirement (per the MPEG spec) is 4 kbytes. Given the 8 kbyte input FIFO in decoder 100 (divisible arbitrarily in two, with minimum resolution of 512 bytes), any audio bursts from the correctly multiplexed MPEG2 transport stream can be accepted, meaning that no extra buffering is required upstream in the associated demux chip. In other words, demux will simply pass any audio data directly to the codec 100, regardless of the transport bit rate, thereby reducing overall system cost.

Also, a significant amount of MIPS can be saved in the output FIFOs, which act as a DMA engine, feeding data to the external DACs. In case there are no output FIFOs the DSP has to be interrupted at the Fs rate (sampling frequency rate). Every interrupt has some amount of overhead associated with switching the context, setting up the pointers, etc. In the case of the codec 100, a 32 sample output is provided FIFO with half-empty interrupt signal to the DSP, meaning that the DSP is now interrupted at Fs/16 rate. Subsequently, any interrupt overhead is reduced by a factor of 16 as well, which can result in 2–3 MIPS of savings.

In the dual DSP architecture of decoder 100 the amount of shared memory is critical. Since this memory is essentially dual ported resulting in much larger memory cells and occupying much more die area, it is very critical to size it properly. Since decoder 100 has two input data ports, and the input FIFO is divisible to receive data simultaneously from the two ports, the shared memory was also designed to handle two data channels. Since the size of one channel of one block of AC-3 data is 256 transform coefficients a 256 element array has been allocated. That is, 256 PCM samples can be transferred at the same time while transferring AC-3 transform coefficients. However, to keep two DSP cores 200*a* and 200*b* in sync and in the same context, an additional 32 memory locations are provided to send a context descriptor with each channel from DSPA to DSPB. This results in the total shared memory size of 544 elements, which is sufficient not only for AC-3 decompression implementation but also for MPEG 5.1 channel decompression as well as DTS audio decompression.

The PCM buffer size is another critical element since all 6 channels are decompressed. Given the AC-3 encoding scheme (overlap and add), theoretically a minimum of 512 PCM data buffer is required. However, given a finite decoder latency, another buffer of 256 samples for each channel is required so that ping-pong strategy can be employed. While one set of 256 samples is being processed, another set of 256 is being decoded. A decode process must be completed before all samples in PCM buffer are played, but given a MIPS budget this is always true. So, no underflow conditions should occur.

Interprocessor Communication (IPC) and Protocol can now be described in further detail in view of the discussion above and FIG. 4. The Dual DSP processor architecture according to the principles of the present invention, is advantageously very powerful in the effective use of available MIPS. However, it is important to remember that the target application must be such that it is relatively easy to split processing between the two engines. Both AC-3 and MPEG-2 multichannel surround applications possess this quality. The essential element to an efficient implementation of these applications is the effective communication between the two engines. In decoder 100 the shared resources between the two processors are the 544×24 word data memory 204 and the communication register file 1302 consisting of ten I/O registers.

These shared resources can advantageously synchronize the 2 DSPs for the task at hand.

1. Shared Data Memory

The basic concept behind the shared memory is that of master and Slave. DSPB is defined as the master in the system, and is also the master of the write access to the shared memory. In the case of a read access DSPA is the master of the shared memory 1302. Both processors are allowed to write and read to and from the shared memory.

The concept of the Access Token is introduced here. Most of the discussion that follows concentrates on write token, however, the same concept applies to read token as well. It is possible that one processor has the ownership of write token and the other has the ownership of the read token. It is also possible that one processor has the ownership of both tokens.

The AB_semaphore_token register (FIG. 4) has the following format:

TABLE 1

| AB_semaphore_token register | | | |
|---|---|---|---|
| RD_PRIVILEGE_B | WR_USE_A | PCM_DATA_READY | TC_READY |

Note that DSPA can both write and read into this register and that DSPB can only read from this register.

The BA_semaphore_token register has the following format:

TABLE 2

| BA_semaphore_toeken register | | | |
|---|---|---|---|
| WR_PRIVILEGE_A | RD_USE_B | BA_DATA1_READY | BA_DATA2_READY |

Note that DSPB can both write and read into this register and that DSPA can only read from this register A. Communication Register File The communication register file (FIG. 4) consists of eight registers. They are split into two groups of four registers each, as shown below.

| |
|---|
| COMMAND_AB [23:0] |
| PARAMETER_0_AB [23:0] |
| PARAMETER_1_AB [23:0] |
| COMMAND_AB_PENDING [0] |
| |
| AB_semaphore_token register |
| COMMAND_BA [23:0] |
| PARAMETER_0_BA [23:0] |
| PARAMETER_1_BA [23:0] |
| COMMAND_BA_PENDING [0] |
| |
| BA_semaphore_token register |

The first group of four registers is used by DSPA to send commands to DSPB, along with appropriate parameters. The second set of registers Is used by DSPB to send commands and parameters to DSPA. So, the communication protocol is completely symmetrical.

Consider the case when DSPA is sending a command to DSPB. Before DSPA can send a command, it must check the COMMAND_AB_PENDING flag to make sure that the previous command from A to B was taken by DSPB. If it is appropriate to send the message, DSPA assembles the parameters, sets the COMMAND_AB_PENDING flag and writes the command itself. Otherwise, DSPA waits at Step 5303. The event of writing the COMMAND_AB_PENDING triggers a DSPB interrupt, which in turn reads the command and its parameters and at the end clears the COMMAND_AB_PENDING flag. (DSPB may also poll the command pending to determine if a message is waiting, rather than receiving an active interrupt from DSPA.) This allows DSPA to then send another command if necessary.

It should be noted that both DSPs have write access to the COMMAND PENDING register but the software discipline will ensure that there is never a conflict in the access. If DSP(A/B) 200*a*, 200*b* cannot issue the command because the COMMAND_AB_PENDING bit is set, it will either wait or put a message into a transmit queue. Once the command is received on the other side, the receiving DSP can either process the command (if it is a high-priority command) or store it into a receive queue and process the command later. Scheduling of command execution will be such that minimum latency is imposed in the system. Regular checking at the channel resolution (about 1 ms) will ensure minimal latency in processing commands.

When one processor is not accepting messages, a timeout is required to inform the Host about the potential problem. If DSPA is not responding to messages from DSPB, the Host will be notified by DSPB. If DSPB is not responding to DSPA, then, most likely, it is not responding to the Host either, and Host will know that explicitly. If DSPB is not responding to DSPA, but it is responding to the Host, DSPA will stall, will stop requesting data, the output buffers will underflow and the demux (or upstream delivery engine) will overflow in pushed systems or time-out in pulled systems.

As discussed above, during the decoding of audio data by decoder 100, an important task is maintaining synchronization between the time stamps embedded during the encoding process and the time base on which decoder 100 is operating. ("Synchronization" assumes an equalization in the time base frequencies has been achieved, and the "time" at the receiver in an absolute sense is sufficiently close to the transmitters.) When synchronization is lost, the decoder will not output the decoded data at the proper time which ultimately results in the absence of appropriate sound at the appropriate instance in the speaker output. The principles of the present invention provide methods for determining whether decoder 100 is operating behind or ahead of the PTSs in the received stream. These methods can be implemented either in software of hardware. High level software routines then can determine if correction must be made by dropping or replicating selected blocks of data and/or samples.

Figure 5A:
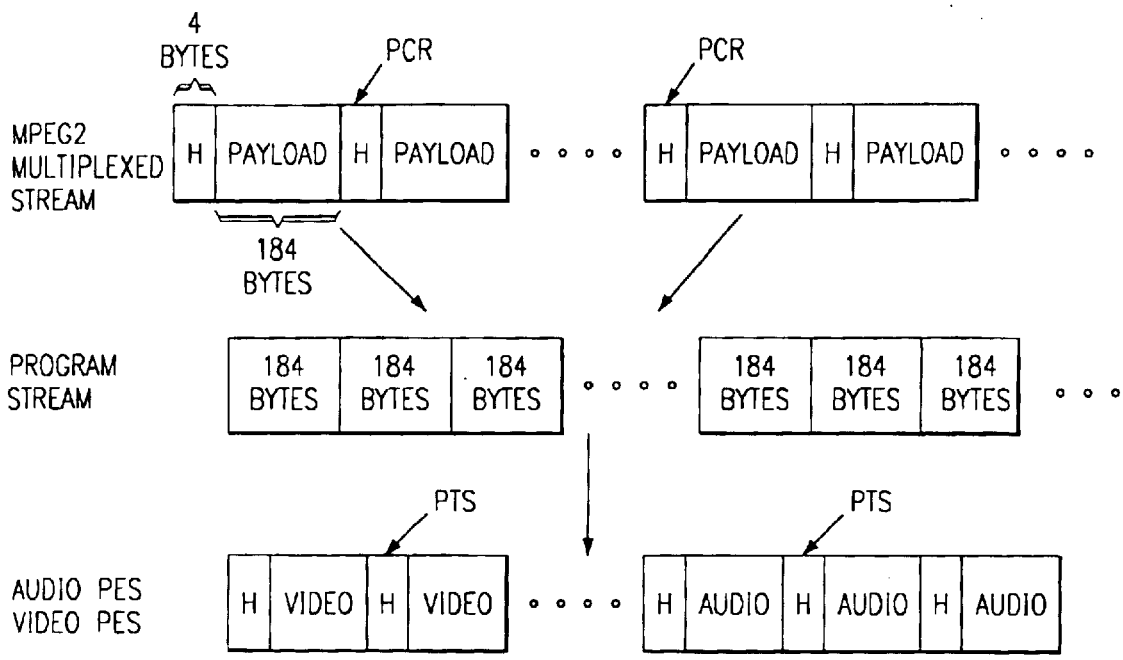
FIG. 5A is a diagram describing the processing of an exemplary MPEG transport stream carrying Packetized Elementary Streams (PES) of MPEG encoded video and AC3 encoded audio.
Figure 5B:
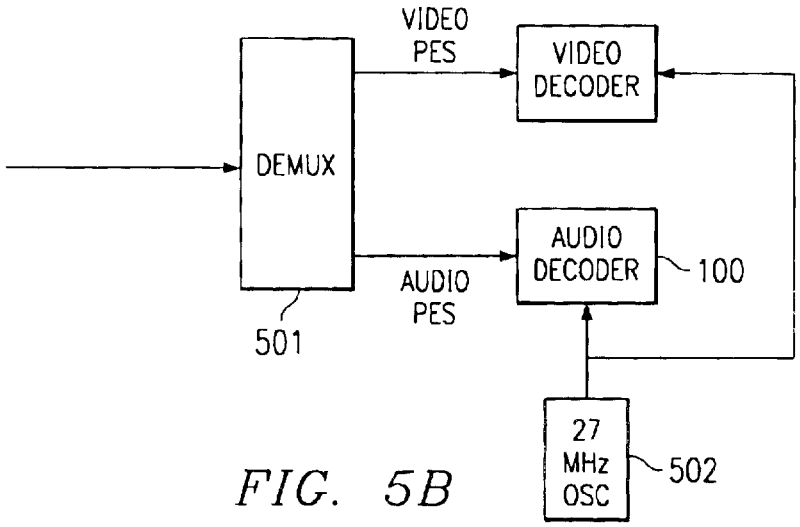
FIG. 5B is a diagram of the high level blocks of a system processing the streams shown in FIG. 5A.

FIGS. 5A and 5B depict the processing of an exemplary MPEG Packetized Elementary Stream (PES) carrying MPEG encoded video and AC-3 encoded audio. The standard MPEG-2 PES or "transport stream" includes 188 byte packets carrying PCR time stamps and a 184-byte payload (Adaption Field). From the transport stream, data is assembled into 184-byte blocks of an intermediate program stream, and then into audio and video PES by demultiplexing software 501. The audio and video at this point is sent on the respective decoder.

A program clock reference (PCR) is periodically inserted into headers of selected packets in the transport stream. The PCR values are time stamps relative to the system time clock (STC) which clocked the encoding of the data. The frequency of the PCR values is a function of the desired rate of update (resynchronization) of the decoder STC.

Figure 6:
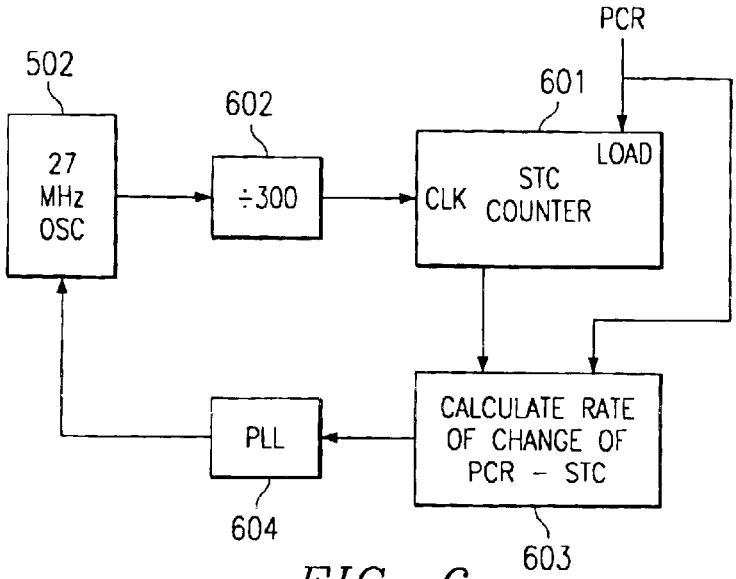
FIG. 6 is a diagram of the system time clock counter of the decoder depicted in FIG. 1.

In decoder 100, an initial PCR value is used to load an STC counter 601, depicted in FIG. 6, which increments with an STC clock generated on the decoder end of the system. The STC clock has a frequency of 90 kHz and is preferably derived from 27 MHz oscillator 502 by dividing by 300 at block 602. Decoder provides other sources for generating the STC in addition.

The current value in counter 602 is then subtracted at block 602 from each PCR value that is received. From the resulting difference, the time rate of change of the decoder STC values with respect to the received PCR values is calculated at block 603. If the time rate of change of the decoder STC values is the same as that of the received PCR values (i.e. the subtraction results in zeros), then the decoder STC frequency equals the frequency of the encoding STC clock and synchronization is being maintained. On the other hand, if the two rates of change differ (i.e. the difference between the two values continues to drift), then the decoding STC frequency does not equal the frequency of the encoding STC clock and the decoder is in an out of synchronization condition at least as far as the time base is concerned.

In the case when synchronization is lost, the decoder STC frequency is adjusted to achieve synchronization. For example, an error signal can be generated and a phase-locked-loop 604 used to vary the frequency of the 27 MHz oscillator used to generate the decoder STC clock. This adjustment process takes a finite amount of time, yet decoder must still continue to process data to support the output data stream.

As discussed above, the demultiplexer hardware and software assembles a Program Stream of 184-byte blocks from the PES payloads. Then, a stream of encoded video and audio data is derived along with the corresponding headers. For example, the video may be MPEG-1 or MPEG-2 encoded and the audio AC-3 encoded. The presentation time stamps (PTS) which indicate the time at which the frames of audio or video data should be presented to the audience in terms of 90 kHz STC time units, are periodically inserted into the headers of selected audio and video data blocks. The audio PTS reference is the first sample in the accompanying PCM payload, as reconstructed from compressed data through the decoding process.

In the event of an out of synch condition due to time base frequency discrepancy and/or decoding problems, decoder 100 ends up processing data before or after the time indicated by the corresponding PTS. When decoder 100 processes data after the time indicated by the PTS stamp has passed, one or more frames and/or subframes and/or samples must be skipped to adjust the presentation of audio to the audience to conform to the time stamp. When decoder 100 is running ahead of the data stream, a buffer underflow condition arises and no data is available to process. Here, the audio decoder waits for data to be played-back until the appropriate time while in the meantime, silence is output.

Decoder 100 determines whether frames and/or subframes and/or samples must be dropped or added during out of synch conditions by determining the sample advantage and/or time advantage between the data being processed and the corresponding PTS value. The sample advantage is the number of samples of audio ahead or behind the sample indicated by the current PTS which should be output at that time. Specifically, the sample advantage is the number of samples of audio the currently played-back sample is ahead or behind with respect to the reference sample. The time advantage is similar, except the difference is expressed in terms of STC time units.

In decoder 100, the pulse code modulated (PCM) data resulting from the decompression of AC-3 data, is stored in a buffer within data memory associated with DSPB. A dipstick indicates the number of PCM samples remaining in this buffer. PCM samples from the memory buffer are transferred to a 32-word deep data output FIFO (DAO) any time the DAO FIFO reaches the half-empty state. Data is output from the FIFO at the sampling frequency Fs. Each time a transfer Is made to the output FIFO or data enter the buffer, the dipstick value changes. Thus, the delay, in number of samples, that a given sample, including the reference sample, sees between its input into the PCM buffer and its output from the DAO FIFO is equal to the time required to output dipstick number of samples plus the number of samples in the output FIFO.

With this in mind, the sample advantage (SA) and time advantage (TA) can be computed:

$$TA=PTS-STC_Ihe-\{(\text{DIPSTICK}+FIFO_SIZE)*(STCFreq/Fs)\}$$

$$SA=\{(PTS-STC_Ihe)*(Fs/STCFreq)\}=(\text{DIPSTICK}+FIFO_SIZE)$$

where:

STCFreq=the frequency of the STC in kHz (nominally 90 kHz);

PTS=the current PTS value in periods of the STC;

STC_Ihe=the STC value in periods of the STC at the last half-empty interrupt to load output FIFO;

DIPSTICK=the number of samples remaining in the memory buffer;

Fs=the sampling frequency in kHZ at which data samples are retrieved from the output FIFO; and FIFO_SIZE=number of samples in output FIFO.

In other words, to calculate the time advantage in periods of the STC, the difference between the time at which the reference word of a block of audio data should be output and the time when that word will actually be clocked through the memory buffer and the output FIFO is determined in the following manner.

The quantity (PTS−STC_Ihe) is the difference in STC periods between the time the reference sample should be presented and the time at which the last interrupt was taken to fill a half-empty output FIFO. The output FIFO can be assumed as full. The number of samples in front of the reference sample at this point is the number of samples ahead of the reference sample in the buffer (DIPSTICK) plus the 32 samples in the output FIFO or (DIPSTICK+32). Multiplying this quantity by the ratio between the STC frequency and the sampling frequency, (STCFreq/Fs) results in the delay through the buffer and FIFO in number of STC time units per sample. This result is subtracted from (PTS-STC_Ihe) to reach the final time advantage value.

A similar process is used to calculate the sample advantage (SA). In this case, the difference between the PTS and the STC time at the last half-empty FIFO interrupt is multiplied by the ratio between the sampling frequency and the STC frequency. The result is number of samples per STC time unit between the PTS and the reload of the FIFO. From this, the DIPSTICK value and the 32 samples in the FIFO are subtracted to determine the number of samples ahead of or behind the processor decoder 100 is outputting data with respect to the PTS.

The time advantage and sample advantage values are then used to maintain synchronization by dropping or adding individual samples. Specifically, samples are added when the time advantage is a positive value and dropped when the time advantage is negative. Similarly, samples are added when the sample advantage is positive and dropped when it is negative. This is in contrast to most existing systems, where entire frames and/or subframes of data are added or dropped.

The time advantage and sample advantage equations set forth above are applicable once decompressed audio (PCM) samples including the referenced sample are available after the decompression process. (The referenced sample associated with the presentation time stamp is again typically the first sample obtained from the decompression of a "block" of compressed data). However, in certain situations, for example, upon initial acquisition of a channel or after recovering from an error, decisions regarding the "playability" of the audio (PCM) samples must be made, preferably before the decompression process since the synchronization decision may turn out to be to drop the block and samples altogether.

In an alternate embodiment, the time advantage and/or sample advantage equations may be evaluated and decisions made prior to the decompression process. However, in this case, the validity of such decisions made prior to the decompression process must be qualified to be meaningful in predicting the synchronicity of playback. (The decompression process by its very nature is a time-consuming process, thereby rendering moot the evaluation of the time advantage and/or sample advantage equations since these equations are inextricably linked to the "current" time/status).

It should be noted that as long as the value "DIPSTICK+FIFO_SIZE", quantified in both the time advantage and sample advantage equations (the units of both "DIPSTICK" and "FIFO_SIZE" being samples), is larger than the number of samples represented by a compressed audio "block" (an integrally encoded unit of data), then the time advantage and/or sample advantage evaluations may be deemed "valid" for pre-decompression purposes. Specifically, by its very nature, the decompression process demands that decompression of an audio block occur in a time that is less than or equal to (in practice, significantly less than) the playback time of that number of samples. As time progresses and samples are played out, the time advantage and sample advantage equations evaluate to the same quantity as long as the value "DIPSTICK+FIFO_SIZE" is "large" enough to accommodate the depletion of samples in that duration. It should be noted that the value STC_Ihe advances each instant the output FIFO is reloaded and that the value "DIPSTICK+FIFO_SIZE" reduces each time samples are withdrawn to load the output FIFO as the output FIFO is drained continually. The value "DIPSTICK+FIFO_SIZE" may only be a non-negative quantity.

Thus, as long as the "DIPSTICK+FIFO_SIZE" sum amounts to more samples than the number of samples represented in an as yet undecompressed block of audio, and because it can be reasonably expected that a properly capable decoder decompresses a block of samples in less time than represented by the time required to play back that block of samples, it is reasonable to expect that the output (left-hand side) of the time advantage and sample advantage equations to be "valid" before commencement of a decompression process such that decisions can be based on that expectation.

In sum, a predictable, accurate measure of the presentation time of a reference sample in the output buffer is obtained which is immune to decode time variations, such as those due to processor load variation, data/context dependent decode complexity fluctuation, and similar factors. Moreover, no presumption or estimation must be made with respects to the decoding delay. In fact, the only significant constraints on this process are that a sufficient number of decoded samples ("units of presentation") be present in the output buffer and that their presentation duration time be sufficiently long to decode the next integrally encoded unit (e.g. block or "data unit").

Typically, the worst case minimum number of decoded samples in the output buffer will equal the number of samples in a data unit since any capable decoder should be able to decode that number of samples in the time required to present them. As discussed above, these decoded samples are placed in the output buffer and then periodically transferred into the final output device (e.g. the output FIFO).

In addition to synchronizing streaming data, the present concepts also allow for "Maximal Prefill" and "Perfect Start." For purposes of the following discussion, Maximal Prefill refers to the ability of a capable decoder, such as decoder 100, to adaptively prefill the output buffer to the maximum possible level prior to the presentation time for the first decoded sample. Maximal pre-fill is the target at the start of a new presentation, when attempting resynchronization after a loss of synchronization, after a change in data channel, or a similar change in the data stream. Perfect Start refers to presentation of the first decoded sample exactly on time (i.e. perfect synchronization).

Advantageously, Maximal Prefill prevents the disruption in the synchronized presentation of decoded samples due to continual deviations in the decode time requirements of the data units over and above the duration of time needed to present the corresponding numbers of samples. Generally, disruption is avoided by maintaining enough presentable samples in the output buffer to mask any additional time required to decode "difficult" units and avoid an output buffer underflow condition. (The decoder cannot ad infinitum compensate for these decode time deviations unless the processes average out, with the time lost on "difficult" units counter-balanced by the time made up on "easy" units.) Moreover, the prefill must be a sufficient cushion to weather accumulated deviation from loss of "capability" by the decoder at any instant during its operation.

A loss of decoder capability can occur for any one of a number of reasons. For example, the computing unit performing various decoding operations may receive a higher-priority interrupt and be forced to perform other pressing tasks first. Consequently, time is lost with respects to the decoding task, which is typically operating in a real-time environment. Alternatively, it may be impractical to design the decoder to handle all possible data streams under the corresponding compression (encoding) standard. Also, there may be delays in arrival of data into the input buffer (FIFO) through the demultiplexer which re-assembles the elementary stream from the transport stream. These are just a few real-world problems which may be encountered during the real-time decoding of a data stream.

There are some constraints on the maximum achievable prefill. Among other things, limitations are imposed by the capacity of the output buffer as well as the amount data available in the input buffer (FIFO). Moreover, when considering prefill, the "Time Advantage,"(here, all the time available to prefill the output FIFO before the first decoded sample is presented) must also be considered.

A sufficient Time Advantage in this context is at least equal to the time required to present one data unit. It may be possible (or desirable) to skip selected integrally encoded units (blocks/frames/sub-frames) and associated time stamps until it is apparent that this Time Advantage is either sufficient or unlikely to improve, given that most transport streams are encoded and multiplexed with a target decoder input buffer fullness that allows for reasonable time to decode and present the streaming data. (Any skipping of streaming data must be balanced against the need to present the available data, albeit not yet synchronized, at the earliest opportunity.) To this end, "stall-side only" refers to the process of skipping integrally encoded units until a sufficient positive Time Advantage is gained prior to decoding and presenting data.

Limits on the processing power at the disposal of the decoder is a further constraint, but only to the extent that it creates a loss of capability condition, such as those discussed above.

Figure 7:
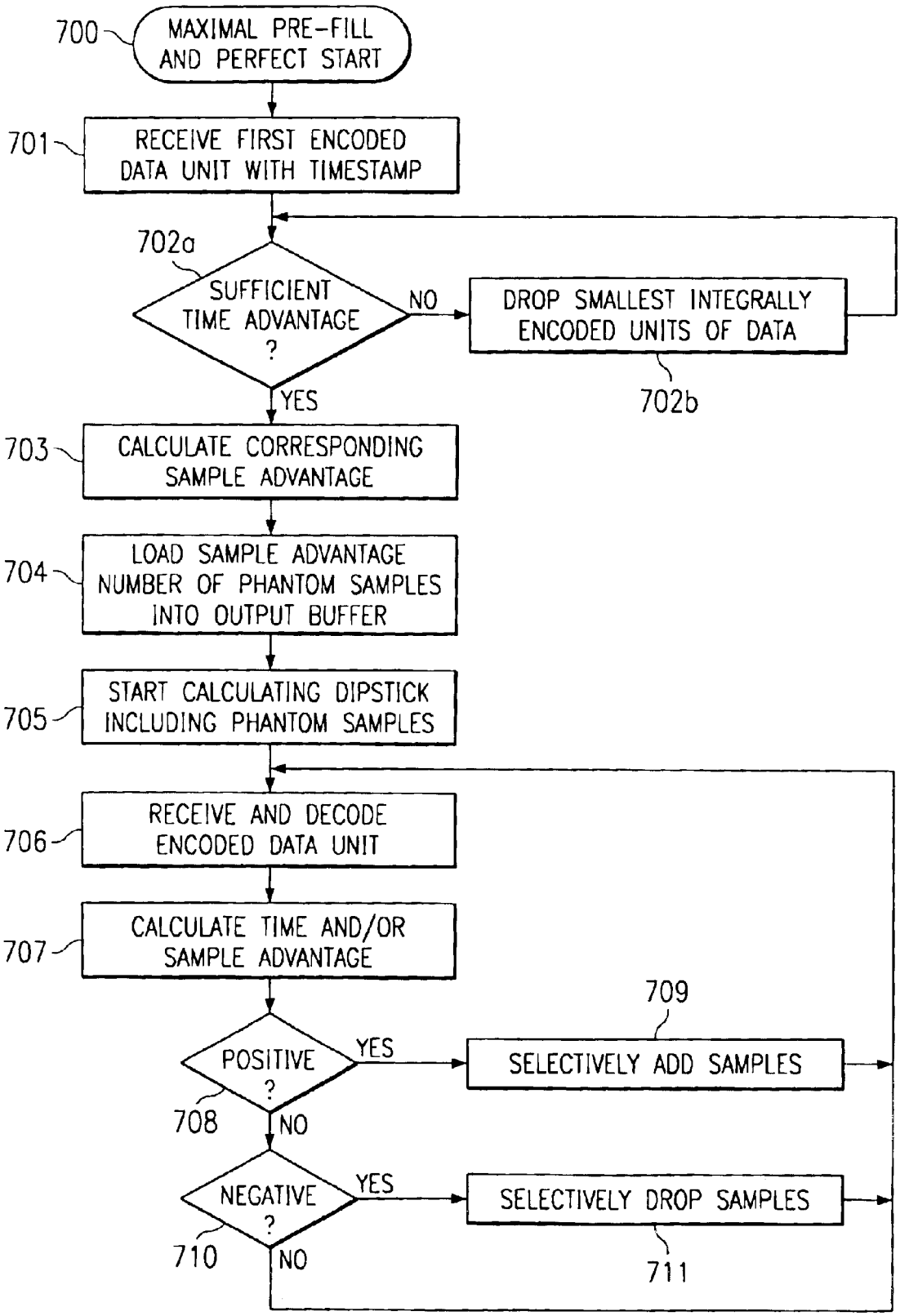
FIG. 7 is a flow chart illustrating a preferred method of maximally prefilling an output buffer and achieving perfect start.

A preferred procedure 700 for achieving maximal prefill is graphically illustrated in the flow chart of FIG. 7. At Step 701, the first encoded data unit with timestamp is received. At Step 702*a*, decoder 100 ensures that there is sufficient positive Time Advantage before commencing decode of that first integrally encoded unit, for example, by selectively dropping blocks, frames, or sub-frames at Step 702*b*. At Step 703, the equivalent Sample Advantage is then determined as previously described.

A cushion of "phantom" samples equal in number to the Sample Advantage is calculated at Step 703 and loaded into the output buffer at Step 704. These "phantom" samples are generated or tagged such that they are indistinguishable from the startup presentation being output by decoder 100. For example, if audio data is being processed, the phantom samples can be generated to produce silence and for video data, can be generated to produce a dark or blank screen. In other words, the phantom samples are treated indistinctly from decoded samples and therefore contribute to the calculation of the output buffer fullness (DIPSTICK) value and are output for presentation at the sampling rate the same as actual data samples.

While the phantom samples are supporting the output stream, actual data samples from the first and subsequent integrally encoded units are decoded and loaded into the output buffer (Step 706). All synchronization decisions are made as discussed above. Specifically, the Time and/or Sample Advantage is calculated at Step 707 using the current DIPSTICK value, as initiated with the phantom samples. If the time/sample advantage is positive (Step 708) then samples are added to obtain synchronization (Step 709). On the other hand, if the advantage is negative (Step 710), samples are dropped for synchronization (Step 711). If the advantage is zero, the presentation components are synchronized and no samples are dropped or added. The process is continuous as encoded data units are input and decoded and the output buffer is emptied and re-filled.

The insertion of the phantom samples allows data to be moved through the data pipeline such that valid computations of Time Advantage and/or Sample Advantage, and consequently a determination of the state of synchronization, can be made. In turn, the necessary steps can be taken to achieve synchronization (e.g., adding or dropping samples). Furthermore, given the assumption that a sufficient Time Advantage is obtained, the phantom samples will not be exhausted before the actual decoded data samples from the first decoded (decompressed) data unit have been loaded into the output buffer behind the phantom samples. Hence, the first (or reference) "real" decoded sample is presented at exactly the instant it was indicated to be presented by the associated timestamp and hence "perfect start" is achieved.

Advantageously, when more than sufficient Time Advantage exists, the additional time can be utilized to produce as large a prefill as the circumstances allow, in contrast with the alternative of waiting, without performing any useful operations, until the time for decoding actual data. Additionally, even with respects to a insufficient yet positive Time Advantage, the inventive method may still be employed, although a perfect start may not be achievable under all circumstances.

When a perfect start is not achievable, for whatever reason, the ability to compute valid time and Sample Advantage values ensures that the appropriate sample add/drop decision can be made such that eventually proper synchronization is reached. The synchronization status of every reference sample being placed in the output buffer is constrained only by the capacity of the output buffer, the amount of streaming data/integrally encoded units in the input buffer/FIFO, the processing power of the decoder and the existence of a sufficiently positive Time Advantage as indicated by the PTS associated with the such unit when compared to the prevailing STC value.

Although the invention has been described with reference to a specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

What is claimed is:

1. A method of operating an output buffer in a system processing streaming data comprising the steps of:

determining a time period in number of samples required or available to process a plurality of data samples;

loading a number of phantom samples into the output buffer equivalent in time to the time period required or available to process the data samples;

streaming the phantom samples from the output buffer for driving an external device generating a presentation; and concurrent with said step of streaming the phantom samples, processing and loading the data samples into the output buffer behind the phantom samples.

2. The method of claim 1 further comprising the step of calculating a fullness value for the output buffer using a number representing at least some of the phantom samples.

3. The method of claim 1 wherein said step of determining a time period comprises the step of determining a sample advantage representing a difference in number of samples being output between a presentation time for a reference sample and time of availability of the reference sample.

4. The method of claim 1 and further comprising the step of obtaining a sufficient time advantage prior to said step of determining a time period, the time advantage representing a time period between a presentation time of a reference sample and time of availability of the reference sample.

5. The method of claim 1 wherein the data samples comprise audio samples and the phantom samples represent silence.

6. The method of claim 1 wherein the data samples comprise video samples and the phantom samples represent dark frames.

7. The method of claim 1 and further comprising the steps of:

receiving a presentation time stamp associated with the data samples; and outputting a selected one of said data samples from the output behind the phantom samples at a time indicated by the presentation time stamp to achieve a perfect start.

8. An audio decoder comprising:

an input port for receiving a stream of audio data;

a data buffer for storing audio samples retrieved from said stream;

an output first-in-first-out memory for sourcing decoded audio data to an external device at a selected sampling rate and loaded from the data buffer when said first-in-first-out memory reaches a partially empty level; and a digital signal processor operable to pre-fill said output memory by:

determining a sample advantage representing a difference in number of samples between a presentation time for a reference sample and time of availability of the reference sample;

loading a number of phantom samples into the output memory equivalent to the sample advantage;

streaming the phantom samples from the output memory at the sampling rate; and during the streaming of the phantom samples, decompressing and loading into the output memory a plurality of data samples.

9. The decoder of claim 8 wherein the digital signal processor is further operable to calculate a dipstick value monitoring the empty level of the output memory, at least some of the phantom samples contributing to the calculation.

10. The decoder of claim 8 wherein the phantom samples represent silence samples.

11. The decoder of claim 8 wherein the digital signal processor is further operable to selectively discard integrally encoded units of data to maximize the sample advantage and maximize pre-fill of the output memory.

12. The decoder of claim 8 wherein the stream of audio data comprises a packetized elementary data stream.

13. The decoder of claim 8 wherein said digital signal processor is a selected one of a plurality of digital signal processors forming a portion of said decoder.

14. The decoder of claim 8 wherein said digital signal processor pre-fills said output memory at a start of a presentation.

15. The decoder of claim 8 wherein said digital signal processor pre-fills said output memory after a change of channel.

16. The decoder of claim 8 wherein said digital signal processor pre-fills said output memory following a loss of synchronization.

17. A method of processing a stream of encoded units of data samples comprising the steps of:

calculating a sample advantage using timing information embedded In selected ones of the encoded units, the sample advantage representing a difference in number of samples between the presentation of a reference sample and the availability of the reference sample for output;

queuing a number of phantom samples substantially equal to the number of samples represented by the calculated sample advantage;

outputting the phantom samples from the queue at a selected rate; and decoding at least some data samples of at least one encoded unit and queuing the decoded data samples behind the phantom samples substantially simultaneously with said step of outputting.

18. The method of claim 17 wherein said step of queuing comprises the step of queuing samples in a first-in-first-out memory.

19. The method of claim 17 wherein a selected one of the decoded samples is output from the queue behind the phantom samples at a time indicated by the timing information to achieve a perfect start.

20. The method of claim 17 further comprising the steps of:

calculating a value representing a number of samples in the queue using selected ones of the queued phantom samples; and queuing selected ones of the data samples when the calculated value falls below a preselected threshold.

* * * * *

UNITED STATES PATENT AND TRADEMARK OFFICE

CERTIFICATE OF CORRECTION

PATENT NO. : 6,937,988 B1 
DATED : August 30, 2005
INVENTOR(S) : Nariankadu Datatreya Hemkumar, Miroslav Dokie and Vladimir Mesarovic It is certified that error appears in the above-identified patent and that said Letters Patent is hereby corrected as shown below:

Column 5,
Lines 22 and 42, “110” should be -- I/O --.

Column 8,
Line 38, “AB message” should read -- AB_message --.

Signed and Sealed this

Thirteenth Day of December, 2005

JON W. DUDAS
*Director of the United States Patent and Trademark Office*